United States Patent [19]

Siebertz

[11] Patent Number: 5,035,372

[45] Date of Patent: Jul. 30, 1991

[54] WINDING DEVICE FOR A YARN, IN PARTICULAR FOR A YARN WITH APPROXIMATELY ZERO ELONGATION

[75] Inventor: Peter Siebertz, Wesel, Fed. Rep. of Germany

[73] Assignee: Georg Sahm GmbH & Co. KG, Fed. Rep. of Germany

[21] Appl. No.: 461,283

[22] Filed: Jan. 5, 1990

[30] Foreign Application Priority Data

Feb. 3, 1989 [DE] Fed. Rep. of Germany ..... 3903214

[51] Int. Cl.[5] ..... B65H 59/38; B65H 51/30

[52] U.S. Cl. ..... 242/45; 242/47.01; 226/45

[58] Field of Search ..... 242/45, 75, 75.51, 54 R, 242/47.01, 47.08, 47.09; 226/42, 44, 45

[56] References Cited

U.S. PATENT DOCUMENTS

| | | | |
|---|---|---|---|
| 2,269,299 | 1/1942 | Wiggins | 242/45 |
| 2,285,654 | 6/1942 | Hanna et al. | 242/45 |
| 2,485,895 | 10/1949 | Larsen et al. | 242/45 |
| 3,031,152 | 4/1962 | Cohen et al. | 242/75.51 |
| 3,744,108 | 7/1973 | Greve | 242/45 X |
| 3,831,873 | 8/1974 | Bense | 242/45 |
| 3,858,416 | 1/1975 | White | 242/45 |
| 3,887,851 | 6/1975 | Loesch | 242/45 |
| 4,953,808 | 9/1990 | Craycraft | 226/45 X |

FOREIGN PATENT DOCUMENTS

| | | |
|---|---|---|
| 0061975 | 10/1982 | European Pat. Off. . |
| 1024472 | 2/1958 | Fed. Rep. of Germany . |
| 1216745 | 5/1966 | Fed. Rep. of Germany . |
| 2139420 | 2/1973 | Fed. Rep. of Germany . |
| 8615787 | 9/1986 | Fed. Rep. of Germany . |
| 3702702 | 9/1987 | Fed. Rep. of Germany . |
| 3723593 | 12/1988 | Fed. Rep. of Germany . |

*Primary Examiner*—Stanley N. Gilreath

*Attorney, Agent, or Firm*—Sixbey, Friedman, Leedom & Ferguson

[57] ABSTRACT

A winding device for a yarn (1), in particular for winding a inelastic yarn (1) about a foundation (2). The device, optionally, includes a yarn guide unit (4) upstream from foundation (2). A rotary drive (5) for the foundation (2) and an unwinding device (6) for the yarn (1) are provided, with the unwinding device (6) including an unwinding drive (8) for unwinding yarn (1) from a supply package or yarn source (7). A yarn tension regulator (9) is embodied, in particular, as a compensating arm mechanism and which produces a feedback signal to an electrical or electronic control (10), such that even extreme yarn tension variations coming from the foundation are reduced and a largely constant yarn tension on the foundation can be achieved without problems. The yarn (1), close to and in front of foundation (2) or in front of upstream yarn guide unit (4) is guided through a speed detector (13), which provides a speed measurement signal to a control unit (10) with the unwinding speed of unwinding drive (8) controlled by the control unit (10) according to the speed measurement signal.

14 Claims, 1 Drawing Sheet

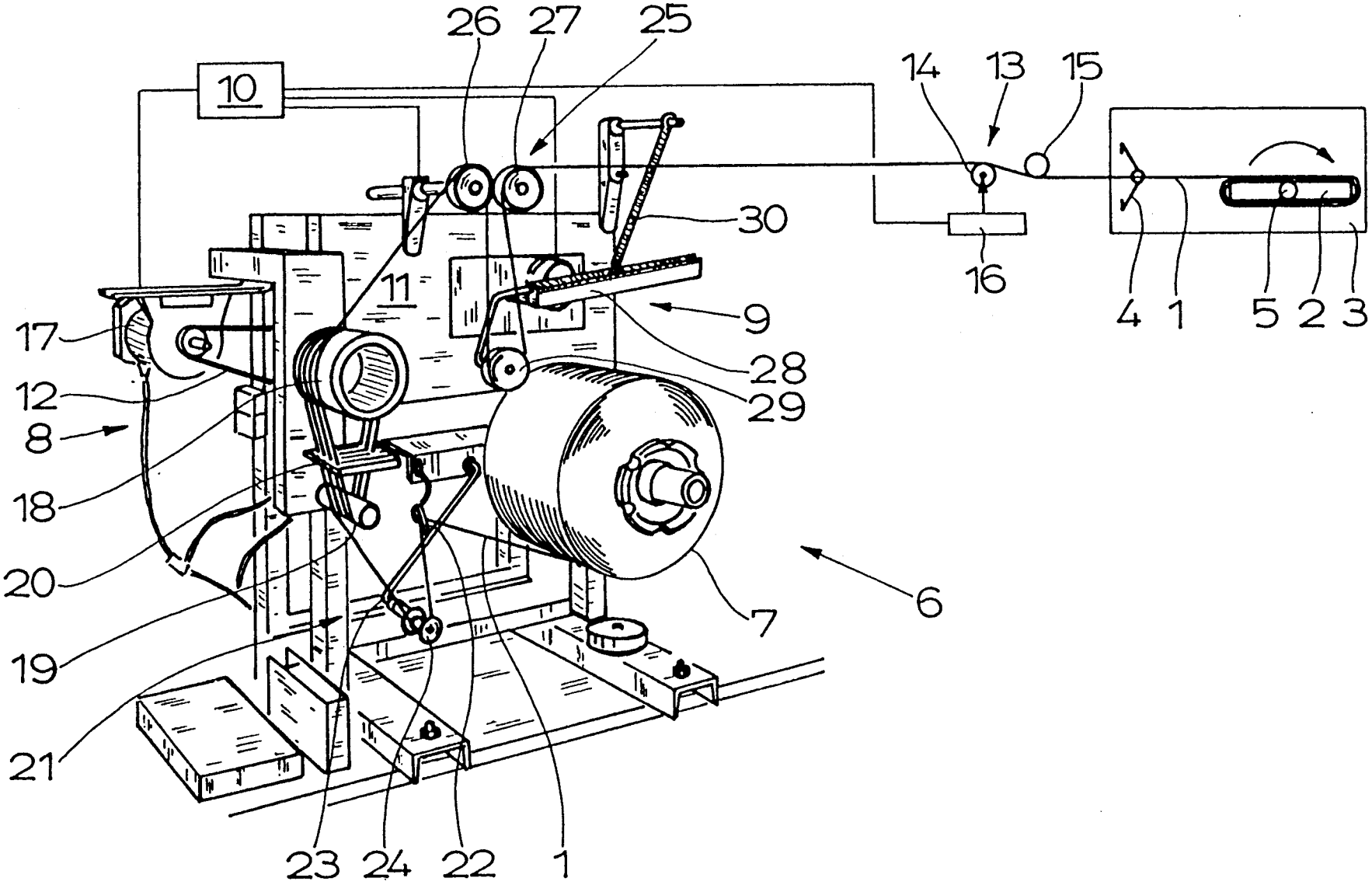
23
22
5
1
4
15
13
16
14
6
30
9
28
29
7
25
27
26
1
22
24
11
23
10
17
12
8
18
20
19
21

WINDING DEVICE FOR A YARN, IN PARTICULAR FOR A YARN WITH APPROXIMATELY ZERO ELONGATION

BACKGROUND OF THE INVENTION

The invention relates to a winding device for a yarn, and in particular for a yarn having little or no elongation. More particularly, the present invention relates to a winding device for a web or yarn in which the yarn is wound on a foundation or article. Especially, to such a winding device where a yarn guide unit is located upstream from the foundation and a rotary drive is provided for the foundation. An unwinding device unwinds the yarn from a supply and a tension regulator controls tension in the yarn as it is fed and wound about the foundation or article. The yarn tension regulator includes a compensating arm mechanism and an electrical or electronic control.

Winding devices of the type in question have been known for a long time. Generally, such devices are utilized to unwind the yarn from the supply package or yarn source and to wind it in a certain way on a foundation, for example, on the foundation of a cheese. Best results are usually achieved when the winding of the yarn on the foundation is performed with as constant a yarn tension as possible. Many developments relate to the problem of how to wind cheeses and other winding bodies or articles with suitable foundations with as constant as possible a yarn tension, or with a yarn tension that changes in a defined or predetermined way (German Patent No. 37 23 593). Very special significance is placed on the right control of the yarn tension during the winding of yarns with approximately zero elongation, for example, of novel plastic filaments such as KEVLAR or the like. The known winding device upon which the present invention is based has a supply package for the yarn that is driven directly by an unwinding drive. The yarn tension regulator is embodied as a compensating arm mechanism. Slight variations in the yarn tension that are caused by the foundation (as it is rotated) can be controlled by the yarn tension regulator. Further, it is also possible to control the unwinding drive according to a measurement signal from the yarn tension regulator. However, because of the mass inertia of the supply package, this control of the unwinding drive is very slow. Since extremely large compensating arm deviations or displacements cannot be tolerated, ultimately, the known winding device only can be used where only slight variations of the yarn tension are to be expected during operation.

SUMMARY OF THE INVENTION

It is therefore an object of the present invention to provide a winding device in which yarn tension variations are reduced or eliminated as the strand or yarn is wound about an article or foundation.

More particularly a further object of the present invention is to solve the problem of controlling tensions in a winding device, such that even large yarn tension variations coming from the foundation are avoided, and a substantially constant yarn tension on the foundation is achieved without problems.

These and other objects are achieved by a preferred embodiment of the present invention using a speed detector which provides a measurement of yarn speed close to, but upstream from, the foundation. The detector provides a measurement signal to a control unit which in turn controls the unwinding drive based upon the detected speed measurement signal.

The invention is based, to start with, on the knowledge that variations in the yarn tension can also come from the foundation even when the rotary drive of the foundation is optimally controlled. A specific control of the rotary speed of the rotary drive of the foundation makes it possible, in many cases, to achieve a control for the specific form or shape of the foundation. With irregularly formed foundations, however, even that is almost impossible because of the inertia of the system having a rotary drive and a foundation with wound-up yarn.

The present invention also considers that the changes in the yarn tension coming from the foundation are, ultimately, only the result of changes in the winding speed of the yarn on the foundation, which result in corresponding accelerations of the yarn. Particularly, with very irregular foundations (i.e., foundations which are irregular when rotated), for example, a flat-rectangular foundation, the winding speeds can be extremely varied depending on the angular position of the foundation.

In consideration of the points noted above, in the winding device according to the present invention, to an extent, a adjustment is made bsed on conditions existing right in front of the foundation, or in front of the yarn guide unit, upstream from the foundation, using the instantaneous speed of the yarn detected by a measurement technique. The measured signal is also conveyed directly to the electronic control from which the unwinding drive of the unwinding device is, then, suitably controlled.

Immediately after increasing or decreasing the winding speed on the foundation, the unwinding drive is correspondingly adjusted far more quickly than the increase in yarn tension which is noticed at the yarn tension regulator, such that sharp tension increases are avoided. The remaining, but considerably shorter, delay in system response (resulting in small tension variations), is not completely avoidable because of inertia, even with the control according to the invention. However, this can easily be controlled by the yarn tension regulator. With the use of the speed detector near the foundation, extreme yarn tension variations coming from the foundation are, thus, reduced, by a control technique, into very slight yarn tension variations at the yarn tension regulator, and with the tension regulator reducing or eliminating the slight tension variations.

These and further objects, features and advantages of the present invention will become more obvious from the following description when taken in connection with the accompanying drawings which show, for illustration only, a single embodiment of the present invention.

BRIEF DESCRIPTION OF THE DRAWINGS

The single FIGURE of the drawing shows, in a perspective, largely diagrammatic view, an embodiment of a winding device according to the invention.

DETAILED DESCRIPTION OF THE PREFERRED EMBODIMENT

The winding device represented in the single Figure of the drawing is particularly suitable for a yarn or web 1 with approximately zero elongation (elasticity), for example, for plastic filaments such as KEVLAR or the like. However, such a winding device can also be used for a yarn with a limited elongation (slight elasticity), with the limited elongation of the yarn being taken into account with control technique by correction factors.

The basic design of a winding device of the type in question includes, on the winding side, first a take-up foundation 2, onto which yarn 1 can be wound. This foundation 2 is attached to a carrier 3, in the embodiment represented here. Upstream, there is usually a yarn guide unit 4, which is indicated, in the drawing, only as a simple yarn guide eye. Note that the guide unit may be eliminated, if desired, such that the yarn passes to the foundation directly from a pressure roller 15 (described below). Also represented is a rotary drive 5 for foundation 2 in the form of a suitable drive shaft. Such a rotary drive 5 is normally an electrical rotary drive, although the particular drive energy utilized may vary within the scope of the present invention.

On the unwinding side, there is an unwinding device 6 for yarn 1 which includes, first, a supply package or yarn source 7 for yarn 1. Unwinding device 6, generally, includes an electrical unwinding drive 8 for yarn 1, a yarn tension regulator 9 and an electrical or electronic control 10. Here, it is shown that unwinding device 6 includes a supporting frame 11 upon which the various parts of unwinding device 6 are attached or mounted. Unwinding drive 8 is equipped here with a d.c. motor 17 and a drive belt 12 that simultaneously achieves a certain reduction ratio.

As explained in detail above, in the general part of the description, one aspect of the present invention relates to the fact that yarn 1 is guided, close to and in front of take-up foundation 2 (or in front of upstream yarn guide unit 4), through a speed detector 13, and the speed measurement signal of speed detector 13 is conveyed to control 10. The unwinding speed of unwinding drive 8 is, in turn, controlled by control 10 according to the speed measurement signal.

In the embodiment represented here, and thus preferred, the speed detector 13 is a tachogenerator with a tachoroller 14 acting on yarn 1. To avoid slip, tachoroller 14 is provided with a guide and pressure roller 15, in a manner known in the art. Suitably, two guide and pressure rollers 15 could also be present. A rotary transducer 16 is indicated by which the rotation of tachoroller 14 is converter into an electronic measurement signal, namely, a speed measurement signal. This speed measurement signal can then be processed by control 10 by a control technique.

There are of course many alternative technical possibilities for achieving speed detector 13 in accordance with the present invention. For example, the speed detector may be an angle encoder, a resolver or the like. Ultimately, the measurement technique used for speed detector 13 depends upon the desired measurement accuracy.

The single Figure already makes clear that, here, according to the present invention, a faster adjustment is achieved by using the speed measuring signal as an actuating signal by which unwinding drive 8 can be adjusted with an extremely slight delay time, as discussed in the general part of the description above.

The present invention can be utilized in combination with a standard unwinding drive 8, as is known in the prior art. In this way, a considerable improvement would already be achieved toward a solution of the problem indicated above. However, the inertia of the known unwinding drive, also, makes another configuration (in the sense of increasing the response rate) desirable. For this purpose, the preferred embodiment of the invention utilizes a supply package 7 which is made, optionally, as a free running package provided with a braking mechanism, and with the unwinding drive 8 acting on yarns 1 drawn from supply package 7, separate from supply package 7.

This configuration is based on the consideration that the response rate of unwinding drive 8 is considerably improved when it is freed from the mass inertia of supply package 7. Even without another free running mechanism between the separated unwinding drive 8 and supply package 7, the lengthened effective lever arm (of the actuating force at the outer periphery of supply package 7, in contrast to the effective lever arm effect of the previously known unwinding drive at the inner periphery of supply package 7) alone provides a considerably improved response time. The response time is even further improved by an interposed free running mechanism, described below.

In other words, by the present invention, the control 10 can control unwinding directly from the supply. However, even better results are achieved by the addition of a separate unwinding device (18, 19, 20) to isolate the effects of the mass of the supply 7.

With respect to the configuration of separate unwinding drive 8, various arrangements are possible within the scope of the present invention. The embodiment represented shows an especially preferred construction in which the unwinding drive 8, that acts on yarn 1, includes a wrap roller 18, driven by a drive motor 17, with a parallel following roller 19 and, optionally, a yarn guide unit 20 between rollers 18, 19. Such a drive is also designated as a galette. Yarn guide unit 20 can consist of numerous guide rods that are parallel to one another to form outwardly open yarn guides, of guide rods made, for example, of highly nonstick plastic, or of other suitable guiding devices. For wrap roller 18, an antislip (high friction) coating is recommended.

Wrap roller 18, and preferably also following roller 19, can easily be formed for low inertia. For example, these rollers can be formed as hollow rollers, as represented in the drawing.

It is especially recommended, as already indicated above, that a yarn guide unit 21 be placed between supply package 7 and unwinding drive 8. Yarn guide unit 21 can, in this case, be set up as a free running mechanism. The embodiment represented, and thus preferred, utilizes a yarn guide unit 21 which includes a stationary guide eye 22 and a guide pulley 24 supported on a swivel arm 23. Swivel arm 23 can be spring loaded, but in the embodiment represented here is arranged so that it hangs downward under only its own weight. In this way, the yarn 1 is given a certain primary stress in this area.

As has been explained above, the supply package 7 is made as a free running package. To accelerate the free running package, yarn guide unit 21, in the embodiment represented here, provides suitable compensation. However, this yarn guide unit 21 can also be used to brake supply package 7 upon reduction of the yarn speed. For this purpose, it is recommended that the braking mechanism of supply package 7 be controlled by swivel arm 23 of yarn guide unit 21. For the embodiment represented, the braking effect of the braking mechanism of supply package 7 is reduced with tightened yarn 1 and is increased with loosened yarn tension and lowering of swivel arm 23.

As with winding devices of the prior art, yarn regulator 9 includes a spatially adjustable guide element 25. In the embodiment represented, a measured value detector is provided to measure the position of guide element 25. The detector produces a position-measurement signal that is conveyed to control 10, and unwinding drive 8 is controlled by control 10, taking the control-measurement signal into account. For this type of control, it is advisable that the position-measurement signal of guide element 25 is also used in control 10 as additional an actuating signal of a control loop whose control signal is conveyed to unwinding drive 8. The control also acts to produce an effect which returns guide element 25 (after displacement relative to a set point position) back to the set point position.

By this control technique, it is achieved that, with very fast speed changes of yarn 1, an additional actuating signal is given to control 10 for unwinding drive 8. In this way, movable guide element 25 can usually be kept in its set point position. The detection of the position of guide element 25 takes into account the influence of the position of guide element 25 on the yarn tension, which unfortunately cannot be completely ignored, but its effect is substantially eliminated by the control.

There are a number of embodiments possible for the yarn tension regulator 9. In the represented and preferred embodiment, the yarn regulator 9 is made as a compensating arm mechanism. This compensating arm mechanism includes, in the embodiment represented, two guide pulleys 26, 27 and a compensating roller 29. The compensating roller 29 lies between the guide pulleys 26, 27 and is supported on compensating arm 28. Preferably, compensating arm 28 is prestressed in a direction away from guide pulleys 26, 27.

Guide element 25 directs the yarn past the compensating roller and compensating arm 29, 28. The prestressing of compensating arm 28 preferred according to the invention is provided by a spring element 30, which, in the illustrated embodiment, is a helical tension spring. Other types of springs can also be used here, as can conventional pneumatic bearings for compensating arm 28. Weighted compensating arms 28 may also be utilized as compensating arm mechanisms; however, the mass inertia may become disruptive in such a case.

For the represented embodiment, in which the yarn tension regulator 9 is a compensating arm mechanism, it is obvious that retaining the set point position of the compensating arm 28 is of quite considerable importance for constant yarn tension. From a control technique viewpoint, by utilizing a predetermined, certain set point position, a specific and then constantly kept yarn tension can be set. By this variant of the control technique (i.e., in utilizing a constant set point), an additional degree of freedom in the control technique sense is gained for the winding device. Put another way, the tension regulator 9, due to the action of the prestressing spring 30 on the compensating arm 28, produces a tension effect on the yarn which varies as the arm shifts, relaxing or further tensioning the spring element 30, as it acts to take up increasing slack due to lowered yarn tension or to introduce more slack as it reacts to increasing tension. As such, by utilizing the position measurement signal as an additional actuating signal, the unwinding speed can be controlled so as to not only insure that the proper tension is obtained as a function of the speed signal from speed detector 30 but also so as to minimize the effect imposed by the compensating arm by reducing the magnitude of its swing and causing it to remain as close as possible to its setpoint position.

The yarn tension regulator 9, provided according to the invention, offers yet another potential control technique in which a third manipulable variable can be considered. Namely, yarn tension regulator 9 has a yarn tension measurement detector. The yarn tension measuring signal of the yarn tension measurement detector is then also conveyed to control 10 which can, then control unwinding drive 8 as a function of the yarn tension measuring signal. In the illustrated preferred embodiment, the yarn tension measurement detector is formed by supporting guide pulley 26 on a bending rod **26*a* or the like of the compensating arm mechanism. Thus, for example, the bending rod 26*a* can be equipped with strain gage sensors 26*b* that are monitored by control 10**, as is the case for the embodiment illustrated in the only figure of the drawing.

Because of the three actuating signals available in the embodiment disclosed, the winding device of this invention achieves an optimal control of unwinding drive 8 in a highly responsive manner. Thus, even with very irregularly formed foundations 2, yarn 1 can be wound with an essentially constant yarn tension. Further, according to the control technique, numerous inputs can be made, so that it is possible to work with even a yarn tension that varies in a very specific predetermined way.

In this regard, while the noted third actuating signal (signal of bending rod) would normally be redundant with respect to the position measurement signal from tension regulator 9, because of the increased response rate associated with the use of the speed-related signal from the speed detector located near the take-up foundation 2 and the fact that yarn tension measurements based on the position of a movable guide element are sometimes not very exact, an additional yarn tension measurement is helpful when extremely high-precision measurements are needed due to the quality of the yarn being wound. That is, this additional yarn tension signal can serve as a correction factor relative to the position measurement signal. As for the manner in which these signals are evaluated and processed by the control unit 10 to produce a control signal for the unwinding device 8, the specific manner of control, per se, forms no part of this invention since, as those skilled in the art will recognize, the manner in which the signals are processed will depend on the type of yarn being wound (e.g. elastic vs. inelastic), the nature of the take-up foundation, and the desired manner in which tension is to be regulated (e.g., substantially constant vs. a predetermined pattern of variance), etc., and that such can be achieved through the use of an appropriate logic circuit or processing algorithm which produces an output signal on the basis of, for example, a summation of the input signals to which appropriate weighing constants has been applied, and can involve the use of derivatives or integrations of such signals, all as is known to do in the signal processing control art. Thus, this invention is directed to use of a speed signal derived from a speed detector in close proximity to a downstream side of the take-up foundation (for achieving a faster response for adjusting the unwinding drive) together with one or more tension-related position-change responsive signals derived from one or more guide elements (for achieving a higher degree of precision in controlling the unwinding drive) as described above, as opposed to any specific manner of processing such signals, or pattern of tension control.

While I have shown and described a single embodiment in accordance with the present invention, it is understood that the same is not limited thereto. Instead, numerous changes and modifications can be made, as will be apparent to those skilled in the art. Therefore, I do not wish to be limited to the details shown and described herein, and intend to cover all such changes and modifications encompassed by the scope of the appended claims.

I claim:

1. A winding device for winding yarns upon a take-up foundation, and in particular inelastic yarns comprising:

mounting means for mounting a take-up foundation;

a rotary drive for rotating a take-up foundation mounted upon said mounting means;

a supply of yarn and means for unwinding yarn from said supply;

speed detection means for detecting yarn speed just upstream from the take-up foundation and for producing a corresponding speed signal;

yarn tension regulator means for regulating yarn tension, said regulator means being positioned just downstream of the means for unwinding and including a spatially displaceable guide element, said guide element having a set point position;

a measured value detector means for producing a position signal as a function the position of the guide element relative to said set point position, and an electronic control unit, said control unit receiving the speed signal from said speed detection means and the position signal from the measured value detector means, and outputting a corresponding control signal for controlling the unwinding speed of said means for unwinding as a function of the speed signal and so as to return said guide element to said set point position.

2. The winding device of claim 1, wherein the speed detector comprises a tachogenerator with a tachoroller in contact with the yarn.

3. The winding device of claim 1, wherein the supply of yarn includes a free running package and wherein the means for unwinding includes a drive which is separate and spaced from the package, said drive acting directly upon yarn drawn from the supply package.

4. The winding device of claim 3, wherein the unwinding drive includes a wrap roller which is driven by a drive motor, the means for unwinding further including a parallel following roller.

5. The winding device of claim 4, wherein the wrap roller has a hollow portion to give the roller low inertia.

6. The winding device of claim 4, further including a yarn guide unit located between said wrap roller and said parallel following roller.

7. The winding device of claim 4, wherein said parallel following roller includes a hollow portion to give the following roller a low inertia.

8. The winding device of claim 3, wherein a yarn guide unit is located between the supply of yarn and the means for unwinding.

9. The winding device of claim 8, wherein the yarn guide unit includes a stationary guide eye and a guide pulley supported on a swivel arm.

10. The winding device of claim 1, further including a yarn guide unit upstream of said foundation mounting means.

11. The winding device of claim 10, wherein said speed detection means is positioned so as to detect yarn speed just upstream of said yarn guide unit.

12. The winding device according to claim 1, wherein said guide element comprises a compensating arm.

13. The winding device of claim 12, wherein the yarn tension regulator means includes two guide pulleys and a compensating roller lying between the guide pulleys and supported on said compensating arm, and wherein said compensating arm is prestressed in a direction away from the guide pulleys; wherein said compensating roller on said compensating arm is part of said guide element.

14. The winding device of claim 12, wherein the yarn tension regulator means includes two guide pulleys and a compensating roller lying between the guide pulleys and supported on said compensating arm; wherein at least one of said pulleys is supported on a bending rod; wherein said at least one guide pulley forms a part of a yarn tension measurement detector means for providing a yarn tension measurement signal to the control unit; and wherein said control signal is also a function of said yarn tension measurement signal.

* * * * *